US006025282A

United States Patent [19]

Dewaegheneire et al.

[11] Patent Number: 6,025,282

[45] Date of Patent: Feb. 15, 2000

[54] TEXTILE FABRIC COMPRISING BUNDLES OF MACHINED METAL FILAMENTS

[75] Inventors: Gabriël Dewaegheneire, Zwevegem; Philip Vansteenkiste, Deerlijk; Wim Van Steenlandt, Sint-Niklaas, all of Belgium

[73] Assignee: N.V. Bekaert, Belgium

[21] Appl. No.: 09/000,164

[22] PCT Filed: Jul. 11, 1996

[86] PCT No.: PCT/EP96/03107

§ 371 Date: Apr. 16, 1998

§ 102(e) Date: Apr. 16, 1998

[87] PCT Pub. No.: WO97/04152

PCT Pub. Date: Feb. 6, 1997

[30] Foreign Application Priority Data

Jul. 14, 1995 [BE] Belgium ..... 9500630

[51] Int. Cl.[7] ..... B32B 15/02

[52] U.S. Cl. ..... 442/6; 442/195; 428/605; 428/606; 428/608; 428/611

[58] Field of Search ..... 442/3, 6, 229, 442/316; 428/222, 605, 606, 608, 613, 611, 614

[56] References Cited

U.S. PATENT DOCUMENTS

| | | | |
|---|---|---|---|
| 4,118,845 | 10/1978 | Schildbach | 29/33 K |
| 4,930,199 | 6/1990 | Yanagisawa . | |
| 4,982,780 | 1/1991 | Stepanenko et al. | 164/463 |
| 4,983,467 | 1/1991 | De Bruyne et al. | 428/605 |
| 5,071,713 | 12/1991 | Francois | 428/606 |
| 5,443,918 | 8/1995 | Banthia et al. | 428/603 |
| 5,631,067 | 5/1997 | Anaf et al. | 428/213 |

FOREIGN PATENT DOCUMENTS

| | | |
|---|---|---|
| 0 390 255 | 10/1990 | European Pat. Off. . |
| 93 09940 | 5/1993 | WIPO . |
| WO 93/18342 | 9/1993 | WIPO . |
| 94 01373 | 1/1994 | WIPO . |

*Primary Examiner*—Terrel Morris
*Assistant Examiner*—Ula C. Ruddock
*Attorney, Agent, or Firm*—Nixon & Vanderhye P.C.

[57] ABSTRACT

Textile fabrics are formed of bundles of machined metal filaments disposed in nearly parallel arrangement in the bundles. The machined filaments have a predominantly quadrilateral cross-section, and an equivalent filament diameter of between 15 and 150 $\mu$m, where the equivalent diameter is the diameter of a circle having the same surface area as the surface area of a filament cross-section.

15 Claims, No Drawings

TEXTILE FABRIC COMPRISING BUNDLES OF MACHINED METAL FILAMENTS

The invention relates to a textile fabric comprising metal filament bundles obtained by machining or shaving.

BACKGROUND OF THE INVENTION

From U.S. Pat. No. 4,930,199 a method is known for manufacturing thin metal filaments by machining, shaving or cutting them off the end face of a thin metal foil coiled around a mandrel. This produces a bundle of nearly parallel filaments with a predominantly quadrilateral cross-section, the equivalent cross-section of which is between 15 and 150 $\mu$m. depending on the thickness of the foil and the cutting speed of the shaving or cutting tool. By equivalent diameter is meant here the diameter of the circle which has the same surface area as the quadrilateral cross-section of the filament.

Since these machined filaments often have a lower tensile strength and are less straight than drawn filaments, they are difficult to process into filament yarns by twisting at the usual speeds.

PURPOSE AND OBJECT OF THE INVENTION

It is therefore an object of the invention to provide a textile fabric comprising bundles of thin metal filaments or metal fibres which are twisted only slightly if at all and which are obtained by means of a machining process. The term textile fabric here refers to a structure which comprises a series of meshes or openings and filament bundles which define the mesh boundaries, such as woven, knitted, knotted, interwoven or tufted structures.

Further, it is an object of the invention to provide a method for manufacturing a textile fabric out of said bundles of thin filaments or fibres in which twisting operations on the bundles are avoided. The rather voluminous bundle of nearly parallel filaments produced by the machining apparatus therefore needs to be densified or compacted in another manner in order afterwards to be processed into a textile fabric by means of knitting, weaving, braiding, knotting or tufting.

Moreover, whenever the initial voluminous character of the machined bundle may afterwards need to be somewhat restored in the textile fabric, the effect of this compaction or consolidation treatment should at least partly be capable of being reversed. For certain applications, it is precisely the is intention to obtain or preserve a relatively voluminous character in the textile fabric, for example with a view to achieving a certain flexibility in the fabric.

The invention therefore provides a textile fabric comprising bundles of metal filaments obtained by means of a machining process in which these filaments have an equivalent filament diameter of between 15 and 150 $\mu$m and are disposed in a nearly parallel arrangement in the bundles. The term 'filaments' here refers both to continuous filaments and staple fibres.

The method according to the invention for the manufacture of the textile fabric comprises the consolidation of the machined filament or fibre bundles by means of a binding agent and the processing of the consolidated bundles into a textile fabric by means of, for example, weaving, knitting or braiding. If so desired, this binding agent can afterwards be removed in order, for example, to restore at least partially the original voluminous character of the bundle. By the term binding agent is meant, on the one hand, a self-supporting filament-shaped or ribbon-shaped object that, for example, as a binding agent can be wrapped in a spiral form around the bundle (wrapping). On the other hand, it can be a glue with which the bundle is covered or enveloped. Depending on its composition, the binding agent can be removed, for example, by means of dissolving, melting of, vaporizing, freezing out, oxidizing or burning away, by pyrolysis, carbonization, or by other chemical reactions.

The invention also relates to the metal filament or fibre bundle itself obtained by machining, and which is consolidated by means of a binding agent and can be utilized, for example, in the method for manufacturing the textile fabric. The textile fabric according to the invention can be utilized for a broad range of applications, each depending on the suitable choice of composition, structure and properties of the metal filaments, of the bundles, in some cases of the binding agent, and of the final structure of the textile fabric.

The metal filaments in the bundles can be of copper, brass, titanium, different types of stainless steel, nickel alloys and other specific types of steel containing, for example, chromium, aluminium and/or nickel and 0.05 to 0.3% by weight of yttrium, cerium, lanthanum or titanium. The latter steels are very resistant to high temperatures (FeCralloy, NiCralloy, Aluchrome) and can therefore be used, for example, in burner membranes, as will be explained below. If the coiled metal foils from which the filaments have to be machined possess a coating layer which is of a different composition than that of the foil itself and which is capable of being machined, then upon machining one obtains bi- or multi-component filaments.

Upon consolidating the bundle, for example, with a binding filament such as described above, one or more other filaments or yarns can, if required, be joined under the binding filament parallel with the metal bundle in order to improve the processability into a textile fabric or in order to fulfil specific functional requirements of the heterogeneous bundle thus obtained and/or of the final textile fabric. It is also possible to manufacture heterogeneous textile fabrics by incorporating other yarn structures into the fabric in addition to (and separately from) the consolidated metal filament bundles. Textile fabrics can also be given a heterogeneous character by constructing limited zones with mutually distinct structures throughout the thickness of these fabrics and/or in their surface, whether or not in combination with the utilization of different types of yarns and/or metal filament bundles. These substructures can then differ from one another in terms of elasticity, compressibility, density, hairiness, smoothness, stiffness, etc. Such structures can be produced for example with flat knitting machines such as the CMS 440 manufactured by the Stoll company (Germany) or the MC7 manufactured by the Universal company.

The consolidated bundles can be used as warp and/or as weft material in all kinds of weaving processes. They can be interwoven into a network, tufted or knitted into weft or warp knitted fabrics on circular or flat knitting machines and on warp knitting machines, including the Rachel machines. The weight of the fabric can be between 300 and 4,000 g/m$^2$ and in particular below 2,500 g/m$^2$. Said bundles can, according to a preferred embodiment, be incorporated into a double-bed flat or circular knitted structure, for example for preventing the edges of the fabric from rolling up.

The invention relates in particular to specific knitted fabrics made of metal filaments or fibres which are resistant to high temperatures and which, surprisingly enough, turn out to be outstanding for use as burner membranes in gas burners, both for surface radiation systems (100 kW/m$^2$ and higher) and for blue-flame systems (up to 10,000 kW/m$^2$).

All this will now be explained on the basis of a number of possible embodiments for a knitted fabric which can be used, for example, as a burner membrane.

DETAILED DESCRIPTION OF EMBODIMENTS

A filament bundle with a metric number (Nm) of between 0.2 and 0.4 is manufactured out of a FeCralloy with 0.1% yttrium by weight in accordance with the machining method described in the U.S. Pat. No. 4,930,199. The utilization in burner membranes of metal fibres of these alloys and obtained by bundled drawing is itself already known, for example, from the European patent 0,390,255 of the applicant. The equivalent filament diameter of the machined fibres herein presented is between 25 and 50, e.g. approximately 36 $\mu$m. A number of these bundles are joined together and stretch broken on a drafting frame into a fibre sliver. A number of slivers are then once again joined together and, after a further drafting operation, again consolidated by the wrapping in a so-called wrapping device of the thus obtained bundle of nearly parallel fibres, for example, with a continuous synthetic filament (as binding agent) with a wrapping speed of between 200 and 500 revolutions/minute. Just previous to wrapping, a fibre core can, if needed, be inserted between the slivers on the drafting frame. The proportion of metal in this consolidated bundle can be between 0.5 and 5. It is by preference between Nm 1.5 and 5.

The thus consolidated bundles are processed on a flat knitting machine (5 to 14 gauge) into a double-bed knitted structure in order better to prevent the subsequent rolling up of the edges of the fabric. The fabric can have a weight between 800 and 2,000 g/m$^2$ e.g. about 1,200 g/m$^2$. The heavier fabrics offer a longer life time. The knitted fabric has preferably a thickness of approximately 2 mm and a weight of 800 to 1,500 g/m$^2$. The construction of the knitted structure can be fairly simple (e.g. interlock and tubular at gauge 7). Synthetic support threads can also be added during knitting in order to facilitate the knitting process. The binding agent (and other non-metallic threads, if any) are then removed by burning them away, thus leaving a knitted fabric in which the voluminosity of the original machined bundle is partially restored. After removal of the binding agent it can also be useful to roll or isostatically compress the knitted fabric in order, for example, to obtain an even more uniform permeability in the fabric.

This knitted fabric is then fixed on a framework in the housing of a premix gas burner in the known manner as a flat or tubular membrane at the level of the flame. Such gas burners are illustrated i.a. in WO 93/18342 of applicant. A conventional propane/air mixture (with stoichiometric mixing proportions and with an excess of air, respectively) is delivered to the burner. It is put into operation for prolonged periods of time with successive cycles ranging from a surface radiation system to a blue-flame system, with sudden interruptions in between. It turns out that the gas permeability of the fabric makes it possible to have a uniform burning front without backfiring of the flame and without generating whistling tones at high flow rates. This is therefore an indication of a good temperature separation between the inlet and the outlet sides of the gas through the membrane. In any case, the emission values for CO and NOx remain low during operation. A pressed or rolled membrane fabric can be recommended, if such should be needed.

This knitted structure offers the advantage that, in contrast to the usual sintered thin membranes, it is pliable. Thus the well-known problem of expansion of the rigid sintered membrane plates is avoided. In addition, the knitted fabrics can be supplied in large surface areas in rolled-up form. This makes it possible to keep the losses low by cutting up the fabric. If knitted Rachel fabrics are utilized, the mesh opening will have to be kept between 0.5 and 5 mm. In particular surface zones of the membrane, the mesh density can be made different from those in adjacent surface zones in order thus to create different local burning systems in the membrane, depending on the gas flow rate used.

Compared to sintered metal fiber burner membranes, the knitted structures offer in addition the advantage that they heat up much more rapidly. It is thus possible, with the fabrics according to the invention to generate very intense heating pulses lasting e.g. less than one second. This interesting feature enables e.g. the use of the fabrics of the invention in certain sections of furnaces for bending glass sheets. Such furnaces may then include zones with differential heating as disclosed e.g. in EP 0,559,697.

Within the framework of the invention, it is also possible to consider utilizing knitted Bekitherm fabrics (e.g. types KNC1, KNC3) from the applicant as burner membrane. These fabrics are made of metal fibres (e.g. of FeCralloy) which are obtained by a process of bundled drawing such as is described in U.S. Pat. No. 3,379,000 and which have an equivalent diameter of between 4 and 50 $\mu$m. This bundle of parallel metal filaments, which is obtained after a leaching treatment of the bundle composite, can be spun into yarn. Before knitting, however, these bundles can al so be wrapped with binding filaments according to the method of the invention. If so desired, two or more yarns or wound bundles can be twisted together for knitting or weaving in order to obtain the desired yarn titres. The yarns or wrapped bundles made up of bundled drawn metal fibres can of course also be processed on a flat knitting machine into a double-bed structure such as described above for the bundles made up of machined fibres. Other metal raw materials may of course be considered for use in applications other than burner membranes.

The textile fabrics of the invention can also be used as filter sheets to trap the coarse particles in hot gas streams. They can also be used as heat shields or curtains at the entree or exit of tunnel furnaces.

The fabrics can also be used to polish e.g. stainless steel surfaces by friction. A tubular knit fabric can e.g. be sleeved on a bar or rod or tube to polish its outer surface by a rubbing treatment.

When coated with catalytically active substances, the fabrics can act as a support sheet for such catalysts in reactors. The fabrics can also be used as a supporting layer in airbag filters.

We claim:

1. A textile fabric comprising bundles of machined metal filaments disposed in nearly parallel arrangement in the bundles, wherein said filaments have a predominantly quadrilateral cross-section, and an equivalent filament diameter of between 15 and 150 $\mu$m, and wherein the equivalent filament diameter is a diameter of a circle having the same surface area as that of a filament cross-section.

2. A textile fabric according to claim 1 characterized in that it is knitted and that it has a weight of between 300 and 4,000 g/m$^2$.

3. A textile fabric according to claim 2 characterized in that it has a double-bed flat or circular knitted structure.

4. A flat knitted textile fabric according to claim 3 in which the equivalent filament diameter is between 25 and 50 $\mu$m and in which the proportion of metal in the bundles is between Nm 0.5 and 5.

5. A textile fabric according to claim 4 with a weight of between 800 and 2,000 g/m$^2$.

6. A gas burner membrane which includes a textile fabric according to claim 5, wherein the filaments are formed of steel alloys containing chromium, aluminum, and between 0.05 and 0.3% yttrium by weight.

7. A textile fabric according to claim 1 characterized in that it is compressed by rolling or by isostatic pressing.

8. A textile fabric according to claim 1 comprising bundles of stainless steel filaments.

9. A textile fabric according to claim 1 comprising bundles of titanium filaments.

10. A textile fabric according to claim 1 comprising filaments made up of steel alloys containing chromium, aluminium and between 0.05 and 0.3% yttrium by weight.

11. A gas burner membrane which includes a textile fabric according to claim 10.

12. A method for manufacturing the textile fabric according claim 1 comprising the consolidation of the filament bundles by means of a binding agent and the processing of the consolidated bundles into a textile fabric by means of weaving, knitting or braiding.

13. A method according to claim 12 in which the binding agent is afterwards removed from the textile fabric.

14. A metal fibre bundle consolidated with a binding agent and intended for use in the method according to claim 12.

15. A bundle which is wrapped with a binding agent and which is formed of a nearly parallel arrangement of machined metal filaments having a predominantly quadrilateral cross-section and an equivalent filament diameter of between 25 and 50 $\mu$m, wherein the equivalent filament diameter is a diameter of a circle having the same surface area as that of a filament cross-section, and wherein the proportion of metal in the bundle is between Nm 0.5 and 5.

* * * * *